US007568282B2

(12) United States Patent
Wollmershauser et al.

(10) Patent No.: US 7,568,282 B2
(45) Date of Patent: Aug. 4, 2009

(54) TOOLS TO MOUNT A CONNECTOR TO A COAXIAL CABLE

(75) Inventors: Steven M. Wollmershauser, San Antonio, TX (US); Yollus Diroo, San Antonio, TX (US); Edward Walter, Boerne, TX (US)

(73) Assignee: AT&T Intellectual Property I, L.P., Reno, NV (US)

( * ) Notice: Subject to any disclaimer, the term of this patent is extended or adjusted under 35 U.S.C. 154(b) by 87 days.

(21) Appl. No.: 11/446,930

(22) Filed: Jun. 5, 2006

(65) Prior Publication Data

US 2007/0277371 A1 Dec. 6, 2007

(51) Int. Cl.
*H01R 43/00* (2006.01)

(52) U.S. Cl. ..... 29/748; 29/750; 29/751

(58) Field of Classification Search ..... 29/748, 29/750, 751, 828
See application file for complete search history.

(56) References Cited

U.S. PATENT DOCUMENTS

| | | | | |
|---|---|---|---|---|
| 5,211,049 | A | 5/1993 | Lucas | |
| 5,392,508 | A * | 2/1995 | Holliday et al. | 29/751 |
| 5,469,613 | A * | 11/1995 | McMills et al. | 29/751 |
| 5,743,131 | A * | 4/1998 | Holliday et al. | 72/409.1 |
| 5,845,393 | A | 12/1998 | DePaiva | |
| 5,941,120 | A | 8/1999 | Jee | |
| 6,089,913 | A * | 7/2000 | Holliday | 439/584 |
| 6,272,738 | B1 | 8/2001 | Holliday et al. | |
| 6,347,450 | B1 | 2/2002 | Langlois et al. | |
| 6,363,560 | B1 * | 4/2002 | Kesinger | 7/107 |
| 6,427,275 | B1 * | 8/2002 | Hung | 7/107 |
| 6,493,929 | B2 | 12/2002 | Holland et al. | |
| 6,536,103 | B1 | 3/2003 | Holland et al. | |
| 6,591,487 | B2 | 7/2003 | Chang | |
| 6,594,888 | B2 | 7/2003 | Chang | |
| 6,671,944 | B2 | 1/2004 | Holliday et al. | |
| 6,684,439 | B2 | 2/2004 | Jeske et al. | |
| 6,691,402 | B2 | 2/2004 | Chang | |
| 6,708,396 | B2 | 3/2004 | Holliday | |
| 6,783,394 | B1 | 8/2004 | Holliday | |
| 7,153,159 | B2 * | 12/2006 | Burris et al. | 439/578 |
| 7,216,431 | B2 * | 5/2007 | Holliday et al. | 30/90.7 |
| 2003/0177586 | A1 | 9/2003 | Chen | |
| 2006/0042346 | A1 | 3/2006 | Holliday et al. | |
| 2007/0113398 | A1 * | 5/2007 | Jonasson | 29/751 |

OTHER PUBLICATIONS

PCT Coaxial Cable Connector Tool images, 3 pages.

* cited by examiner

*Primary Examiner*—C. J Arbes
(74) *Attorney, Agent, or Firm*—Hanley, Flight & Zimmerman, LLC

(57) ABSTRACT

Methods and tools to mount a cable connector to a coaxial cable are disclosed. An illustrated example tool includes an opening to enable viewing into a cable connector mounted on the tool to determine the position of an inner dielectric insulator of the coaxial cable relative to the connector without removing the connector from the tool.

12 Claims, 4 Drawing Sheets

TOOLS TO MOUNT A CONNECTOR TO A COAXIAL CABLE

FIELD OF THE DISCLOSURE

This disclosure relates generally to a coaxial cable and, more particularly, to methods and tools to mount a cable connector to a coaxial cable.

BACKGROUND

Coaxial cables are used for the transmission of signals to various devices such as televisions, stereo equipment, computers, VCRs, cable converters (sometimes referred to as set top boxes), electronic systems, etc. Some such coaxial cables include a centrally located wire conductor surrounded by an inner dielectric insulator. The inner dielectric insulator is encased by a metallic foil and a sleeve of fine braided metallic strands, or combinations of both foil and sleeve strands. An outer dielectric jacket surrounds and protects the sleeve.

Coaxial cable connectors are mounted at each end of the coaxial cable. A coaxial cable connector is generally tubular-shaped and has internal threads at a front end to receive a threaded interface port of an electronic device. A rear end of the connector is open to receive therein the coaxial cable. A noncompressible metal ferrule is mounted inside the cable connector to receive the inner dielectric insulator of the coaxial cable. The rear end of the cable connector is crimped or compressed to secure the cable connector to the coaxial cable.

Several tasks are accomplished manually to mount a cable connector to an end of a coaxial cable. First, a cable installer strips away a predetermined length of the outer dielectric jacket and the sleeve to expose the metallic foil and the inner dielectric insulator. Any remaining portions of the outer dielectric jacket and sleeve may be folded back over the outer dielectric jacket. The wire conductor protrudes well beyond an end of the dielectric insulator. The cable installer then uses one hand to grip one end of the coaxial cable and the other hand to grip the cable connector, inserts an end of the coaxial cable into the cable connector so that the wire conductor extends into the ferrule, and then forcibly pushes the cable connector further onto the coaxial cable such that the ferrule is forced between the sleeve of braided metallic strands and the metallic foil located about the dielectric insulator. The insertion of the ferrule between the sleeve and the metallic foil encasing the dielectric insulator provides a non-compressible metal structure inside the coaxial cable. The dielectric insulator is seated (e.g., inserted a predetermined distance) in the ferrule by inserting the dielectric insulator to an end of the ferrule. The seating of the dielectric insulator is verified by the cable installer looking into the front end of the cable connector to determine that the dielectric insulator is located adjacent the end of the ferrule. Then a compression tool is used to crimp or compress the rear end of the connector to the coaxial cable. The outer dielectric jacket and any metallic strands of the sleeve are compressed between the crimped rear end of the cable connector and the non-compressible metal ferrule to fasten the cable connector securely to the end of the coaxial cable. Finally, the installer cuts or trims the wire conductor to a predetermined length so the wire conductor extends slightly beyond the front end of the cable connector, and, as necessary, adjusts the wire conductor to the center of the cable connector.

The mounting of the cable connector to the cable requires manual dexterity and can be tiring. Further, the small size of the connector makes the connector awkward to handle. The mounting procedure is further complicated by the existence of different size coaxial cables and cable connectors. If the wrong size cable is inserted into a cable connector (e.g., the cable jacket is too large or too small), or the wire conductor is the wrong size relative to the electronic devices being connected by the coaxial cable, the procedure must be repeated to install the correct size cable and cable connector.

DETAILED DESCRIPTION

Example methods and tools to mount a cable connector to a coaxial cable disclosed herein enable a cable installer to determine that the correct size coaxial cable and wire conductor are being utilized for a particular installation, to easily handle and manipulate the coaxial cable and the cable connector, and/or to verify the position of the dielectric insulator within the cable connector.

Figure 1:
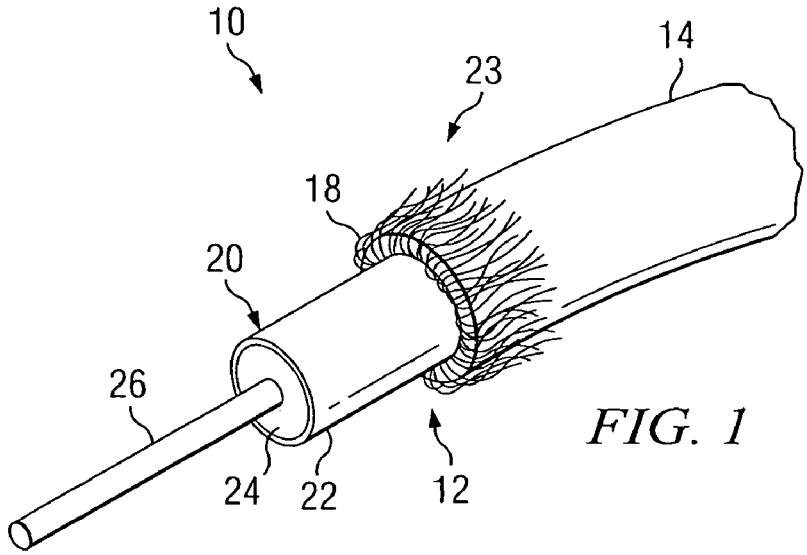
FIG. 1 is a schematic illustration of an example coaxial cable having an outer dielectric jacket and a sleeve stripped away and partially folded back over the jacket to expose a foil encased, dielectric insulator and a wire conductor.

FIG. 1 illustrates schematically an example coaxial cable 10 having at a distal end 12 an outer dielectric jacket 14 surrounding a sleeve 18 of fine braided metallic strands such as aluminum strands. The sleeve 18 encases an inner dielectric insulator 20 covered by a metallic foil such as an aluminum foil 22. A wire conductor 26 such as a copper clad steel wire protrudes from the center of the dielectric insulator 20. In FIG. 1, the example coaxial cable 10 is prepared to receive thereon a cable connector such as the example metallic cable connector 30 illustrated in FIG. 2. As can be readily seen in FIG. 1, at the distal end 12 of the example coaxial cable 10, the outer dielectric jacket 14 and the sleeve 18 have been partially removed. Remaining portions, indicated generally by reference numeral 23, of the outer dielectric jacket 14 and strands of the sleeve 18 are folded back over the outer dielectric jacket 14 to expose a length of the dielectric insulator 20 covered by the foil 22. The dielectric insulator 20 extends beyond the folded back, remaining portions 23 to an insulator end 24. The wire conductor 26 extends from the insulator end 24 of the dielectric insulator 20.

Figure 2:
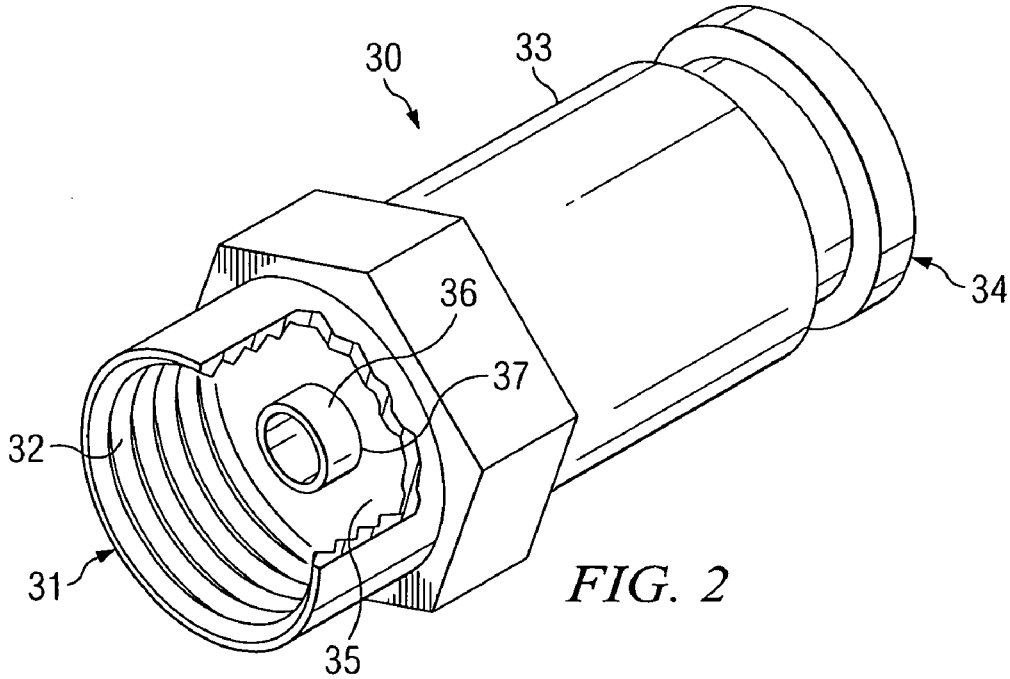
FIG. 2 is a schematic illustration of an example coaxial cable connector.

Referring now to FIG. 2, the example coaxial cable connector 30 includes a front end 31 having internal threads 32, a longitudinal body portion 33 extending to a rear end 34, and an internal lateral portion 35 (in the illustrated example, an annular ring) that positions a ferrule 36 within the connector 30. An end 37 of the ferrule 36 is located adjacent the front end 31 of the example cable connector 30.

Figure 3:
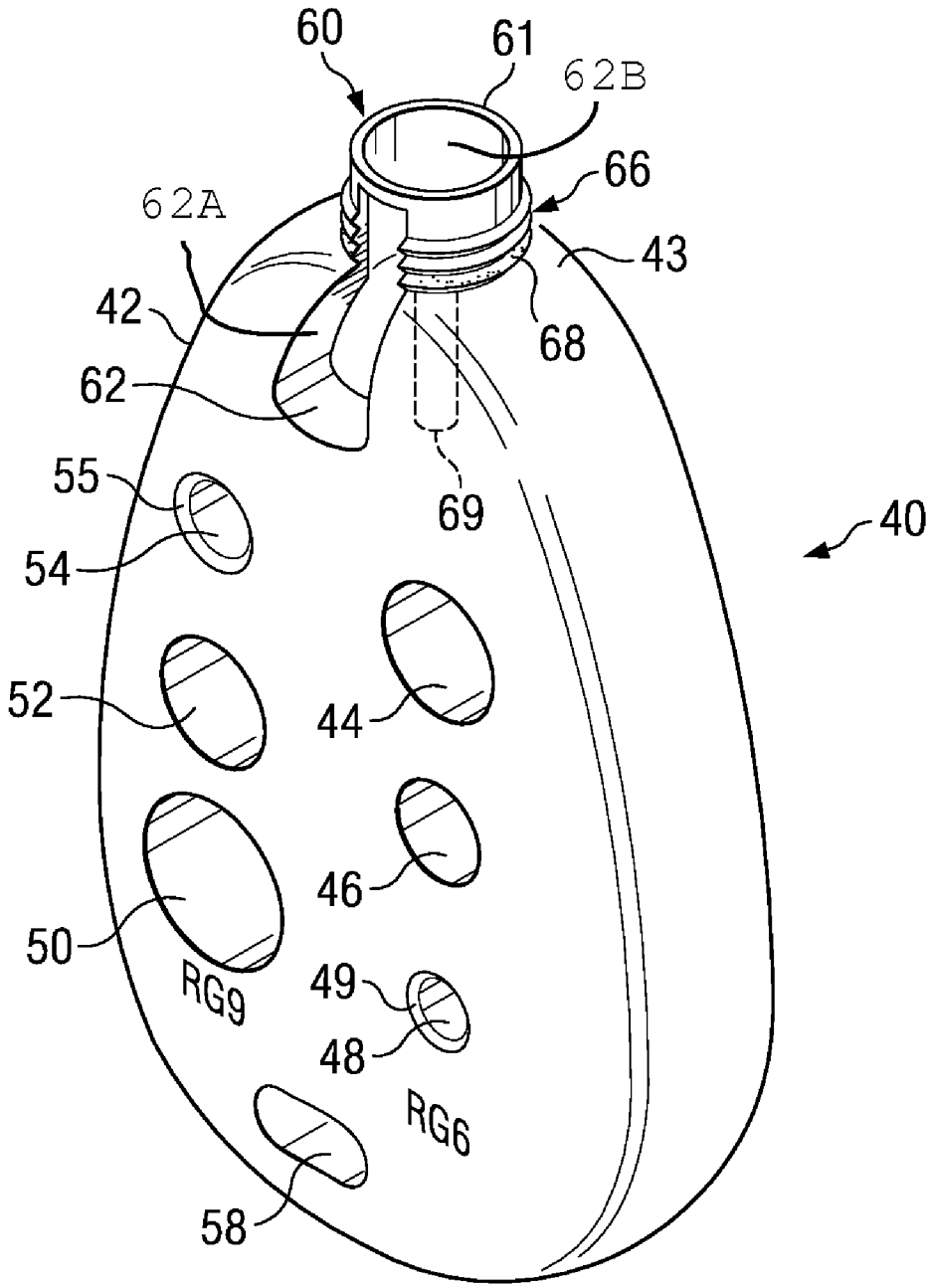
FIG. 3 is an illustration of an example tool to mount the example coaxial cable connector of FIG. 2 onto the example coaxial cable of FIG. 1.

FIG. 3 is an illustration of an example tool 40 to mount the example cable connector 30 of FIG. 2 onto the example coaxial cable 10 of FIG. 1. The example tool 40 includes a body or grip portion 42 having two sets of measuring openings (designated respectively in FIG. 3 by reference numerals 44, 46 and 48, and 50, 52 and 54). A cylindrically-shaped connector mount 60 extends from an end 43 of the grip portion 42. As can be readily seen in FIG. 3, the measuring openings 44, 46 and 48 of the illustrated example are for a standard RG6 size coaxial cable, and the measuring openings 50, 52 and 54 of the illustrated example are for a standard RG9 size coaxial cable. The measuring opening 44 may be used by a cable installer to measure and confirm a maximum outer diameter of the outer dielectric jacket of a coaxial cable (e.g., to confirm that the maximum diameter of the jacket is the diameter of an RG6 cable). If an end of a coaxial cable is too large to enter into the measuring opening 44, the cable is too large to be an RG6 coaxial cable. In a similar manner, the measuring opening 46 may be used to measure and confirm the minimum outer diameter of the outer dielectric jacket of the coaxial cable. If the end of the coaxial cable is smaller than the measuring opening 46, the cable is too small to be an RG6 coaxial cable. The measuring opening 48 of the illustrated example may be used to measure and confirm the diameter of the inner dielectric insulator of the coaxial cable. If an end of the inner dielectric insulator of the coaxial cable does not fit snugly in the measuring opening 48, the cable is not an RG6 coaxial cable.

In the illustrated example, the measuring opening 48 also includes a beveled surface 49 adjacent the surface of the grip portion 42. When the end of the inner dielectric insulator of a coaxial cable is inserted into the measuring opening 48, the end of the insulator will engage the beveled surface 49 and be slightly compressed. The slightly compressed or shaped end of the inner dielectric insulator can then be more easily inserted into a coaxial cable connector, such as the example cable connector 30 illustrated in FIG. 2, during the mounting of the cable connector onto the end of the coaxial cable.

As similarly disclosed above for measuring openings 44, 46 and 48, the measuring openings 50, 52 and 54 illustrated in FIG. 3 are for a standard RG9 size coaxial cable. The measuring opening 50 of the illustrated example may be used by a cable installer to measure and confirm a maximum outer diameter of the outer dielectric jacket of a coaxial cable (e.g., to confirm that the maximum diameter of the jacket conforms to the diameter of an RG9 cable). If an end of a coaxial cable is too large to enter into the measuring opening 50, the cable is too large to be an RG9 coaxial cable. In a similar manner, the measuring opening 52 of the illustrated example may be used to measure and confirm the minimum the outer diameter of outer dielectric jacket of the coaxial cable. If the end of the coaxial cable is smaller than the measuring opening 52, the cable is too small to be an RG9 coaxial cable. The measuring opening 54 of the illustrated example may be used to measure and confirm the diameter of the inner dielectric insulator of the coaxial cable. If an end of the inner dielectric insulator of the coaxial cable does not fit snugly in the measuring opening 54, the cable is not an RG9 coaxial cable. In the illustrated example, the measuring opening 54 includes a beveled surface 55 adjacent the surface of the grip portion 42. When the end of the inner dielectric insulator of a coaxial cable is inserted into the measuring opening 54, the end of the inner dielectric insulator will engage the beveled surface 55 and be slightly compressed. The slightly compressed or shaped end of the inner dielectric insulator may then be more easily inserted into a coaxial cable connector, such as the example cable connector 30 of FIG. 2, during the mounting of the cable connector onto the end of the coaxial cable.

The grip portion 42 also includes a through opening 58 that enables the tool 40 to be attached to a key ring, key clip or similar attaching article so the tool 40 may be carried on a belt, strap, loop or other article which may or may not be worn and/or otherwise carried by a cable installer.

As shown in FIG. 3, the example tool 40 includes at least one longitudinal opening 62 that extends from adjacent an end 61 of the connector mount 60 and into the grip portion 42 of the example tool 40. Alternatively, the longitudinal opening 62 may be a first opening 62A in the grip portion 42 and a second opening 62B in the connector mount 60. The first opening 62A and the second opening 62.B may be aligned and/or in communication. Also, the connector mount 60 may be square-shaped with beveled corners, or any other shape that accommodates threads at the exterior of the connector mount 60. In the illustrated example, threads 66 are located about the connector mount 60 adjacent the grip portion 42. The threads 66 comprise approximately two or three threads so that when a cable connector either is or is to be coupled to the connector mount 60 by engagement with the threads 66, the cable connector may be quickly detached or attached with a minimum of rotation.

In the illustrated example, a thread 68 of the threads 66 is disposed adjacent the grip portion 42. The thread 68 has a knurled surface so that when a cable connector is threaded onto the threads 66, the engagement of the threads of the cable connector with the knurled thread 68 results in the cable connector tightly engaging the connector mount 60. However, the cable connector may still be rotated manually and removed from the example tool 40.

Additionally, the threads 66 of the illustrated example are located adjacent the grip portion 42 so that, when a cable connector, such as the example cable connector 30 in FIG. 2, is attached threadingly to the connector mount 60, the cable connector engages tightly the connector mount 60 and, simultaneously, the front end of the cable connector engages the grip portion 42 of the example tool 40. The engagement of the cable connector with the grip portion 42 transmits forces acting upon the cable connector to the grip portion 42 during the mounting of the cable connector to a cable, thereby reducing the transmission of those forces to the threads 66 of the connector mount 60.

As can be readily seen in FIG. 3, the grip portion 42 of the illustrated example tool 40 includes an opening 69 (shown in phantom) to receive the wire conductor of a coaxial cable inserted into a cable connector attached to the connector mount 60. Typically, the wire conductor of a coaxial cable is of such a length so as to extend well beyond the front end of the cable connector during the mounting of the cable connector to the coaxial cable. After the cable connector is secured or mounted to the coaxial cable and removed from connector mount 60, the wire conductor is trimmed or cut to a desired length, typically such that the end of the wire conductor terminates a short distance just beyond the front end of the cable connector.

The example tool 40 of FIG. 3 may be used to perform some or all of the tasks required to mount a coaxial cable connector, such as the example coaxial cable connector 30, to a coaxial cable, such as the example coaxial cable 10. For example, the cable installer may obtain a coaxial cable 10 such as the example cable illustrated in FIG. 1. A portion of the outer dielectric jacket 14 and at least some of the underlying sleeve 18 (e.g., the metallic strands) are stripped away or removed. Remaining portions 23 of the jacket 14 and the strands of the sleeve 18 are folded back over the jacket 14. A length of the inner dielectric insulator 20 which may or not be covered by the foil 22, extends beyond the remaining portions 23. The wire conductor 26 extends from the end 24 of the inner dielectric insulator 20.

To determine whether the example coaxial cable 10 is the desired size coaxial cable for the particular installation, the cable installer may use the example tool 40 to confirm the size of the example coaxial cable 10. Using an RG6 size coaxial cable installation as an example, the cable installer may insert the distal end 12 of the example coaxial cable 10 illustrated in FIG. 1 into the measuring opening 44 of the example tool 40. If the distal end 12 can be inserted into the measuring opening 44, then the example tool 40 confirms that the coaxial cable 10 is not too large to be an RG6 cable installation. Next, the cable installer may insert the distal end 12 of the example coaxial cable 10 into the measuring opening 46. If the distal end 12 can be inserted into the measuring opening 46 and the outer dielectric jacket 14 generally engages the circumference of the measuring opening 46, the coaxial cable 10 is confirmed to be at least the minimum diameter size coaxial cable required for an RG6 cable installation. Finally, the cable installer may insert an end 24 of the inner dielectric insulator 20 (which may be foil covered) into the measuring opening 49. If the end 24 of the inner dielectric insulator 20 fits snugly into the measuring opening 48, then the inner dielectric insulator 14 is the correct size for an RG6 cable installation. When fitting the end 24 of the inner dielectric insulator 20 into the measuring opening 48, the inner dielectric insulator 20 will initially engage and then be slightly compressed by the beveled surface 49.

Figure 3A:
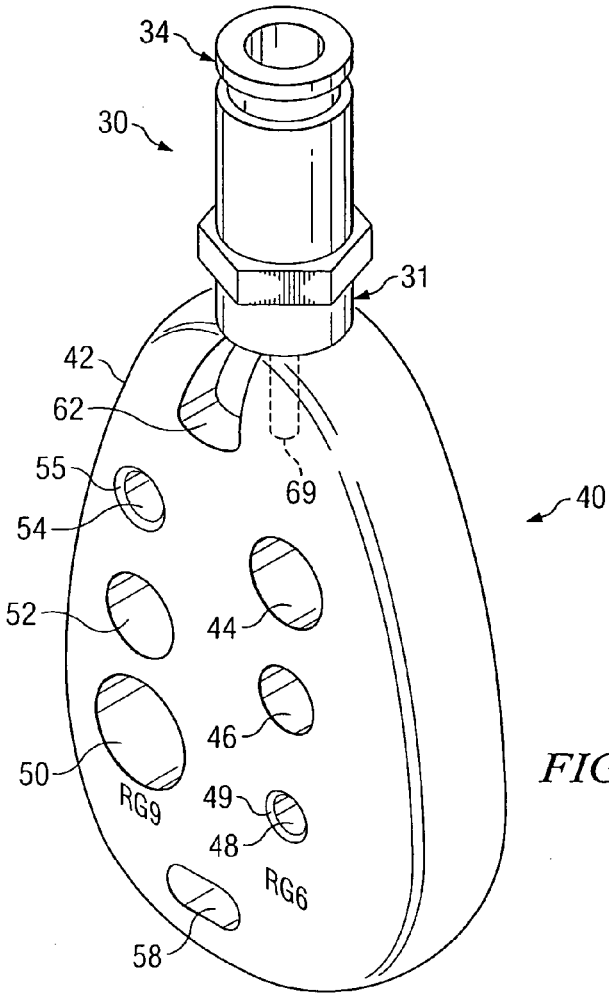
FIG. 3A is an illustration of the example coaxial cable of FIG. 2 mounted on the example tool of FIG. 3.

After using the example tool 40 to confirm the outer dielectric jacket 14 and the size of the foil covered, inner dielectric insulator 20 correspond to the desired cable specification, the cable installer may use the example tool 40 to attach or mount the example connector 30 of FIG. 2 to the distal end 12 of the example coaxial cable 10. To this end, the cable installer may hold the example tool 40 in one hand and insert the connector mount 60 into the front end 31 of the example cable connector 30, which may be held in the other hand. The cable installer threadingly engages the internal threads 32 of the cable connector 30 with the threads 66 of the connector mount 60 to tighten the cable connector 30 to the connector mount 60, and may continue to thread the cable connector 30 onto the connector mount 60 until the internal threads 32 engage the knurled thread 68. When the example cable connector 30 tightly engages the connector mount 60, the front end 31 of the cable connector 30 engages the grip portion 42 of the example tool 40. During the mounting of the example coaxial cable 10 to the example coaxial cable connector 30, the engagement of the cable connector 30 with the grip portion 42 transmits forces acting upon the cable connector 30 to the grip portion 42 and reduces the transmission of those forces to the threads 66 of the connector mount 60. As shown in FIG. 3A, the cable connector 30 is mounted on the connector mount 60 of the example tool 40 and is ready to receive the distal end 12 of the example coaxial cable 10.

Next, the cable installer holds the grip portion 42 of the example tool 40 and pushes the distal end 12 of the example coaxial cable 10 into the example cable connector 30. As the connector 30 is pushed onto the coaxial cable 10, the wire conductor 26 and the inner dielectric insulator 20 enter into the ferrule 36 of the cable connector 30. Typically, pushing the example cable connector 30 onto the example coaxial cable 10 may involve manipulating the cable connector 30 so the ferrule 36 is forced between the strands of the sleeve 18 and the inner dielectric insulator 20 (which may be foil covered). Both the manipulation of the cable connector 30 and most of the force exerted by the cable installer on the cable connector 30 via the example tool 40 are employed to insert the ferrule 36 into the cable 10. The grip portion 42 of the example tool 40 provides an enlarged surface that may be held by the cable installer to make manipulation of the cable connector 30 mounted on the connector mount 60 significantly easier to accomplish than can be achieved without the example tool 40.

The example cable connector 30 is pushed onto the example coaxial cable 10 until a portion of the cable 10 (e.g., the insulator end 24 of the inner dielectric insulator 20) is located or seated at a desired position inside the cable connector 30. To confirm that the insulator end 24 of the inner dielectric insulator 20 is adjacent the end 37 of the ferrule 36, the cable installer may look or view through the longitudinal opening 62 of the connector mount 60 and into the inside of the cable connector 30. If desired, the cable installer may orient the example tool 40 such that a side of the example tool 40 containing the through opening 58 is located closer to the cable installer than a side of the example tool 40 containing the cable connector 30. Such an orientation may further enhance the view through the opening 62 into the inside of the cable connector 30 to determine that the insulator end 24 of the dielectric insulator 20 is at the desired position. If the cable installer determines that the insulator end 24 is not at the desired position adjacent the end 37 of the ferrule 36, the installer can move the cable 10 until the insulator end 24 is adjacent the end 37. Once the cable installer has confirmed the inner dielectric insulator 20 is in the desired position, the installer may then use any crimping or compression tool to crimp or compress the rear end 34 of the cable connector 30 to the coaxial cable 10. Alternatively, the cable installer may rotate either the example tool 40 or the coaxial cable 10 to remove the connector 30 from the connector mount 60 before using a crimping or compression tool to secure the connector 30 to the coaxial cable 10. The cable installer may cut or trim the wire conductor 26 to a predetermined length so the wire conductor 26 extends slightly beyond the front end 31 (e.g., see FIG. 4) of the cable connector 30 and may, as necessary, adjust the wire conductor 30 to the center of the cable connector 30.

Figure 4:
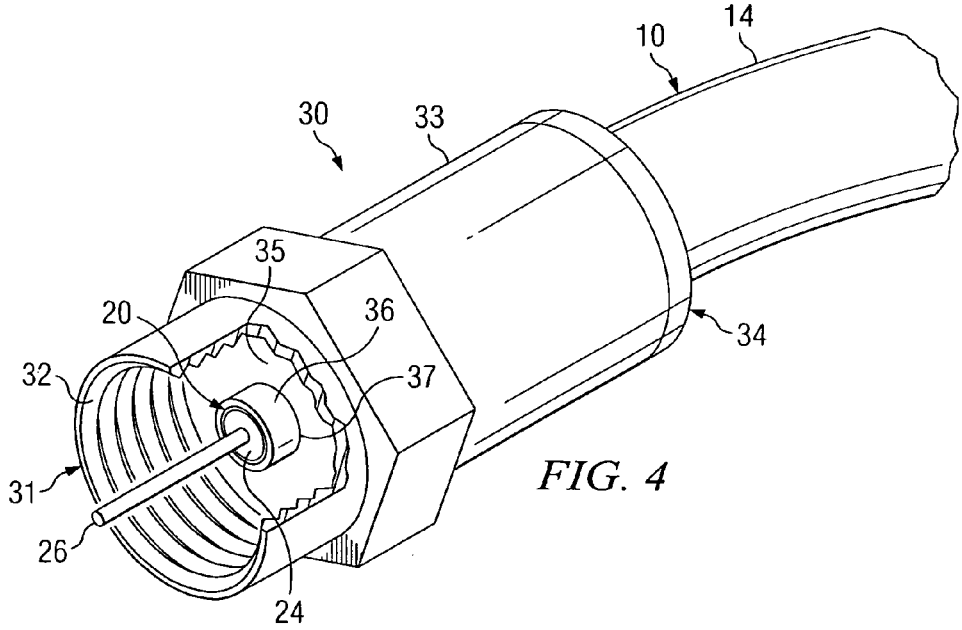
FIG. 4 is an illustration of the example coaxial cable connector of FIG. 2 mounted on the example coaxial cable of FIG. 1.

FIG. 4 is an illustration of the example coaxial cable connector 30 mounted on the example coaxial cable 10. As shown in FIG. 4, the rear end 34 of the example cable connector 30 has been compressed or crimped to secure the example cable connector 30 to the example coaxial cable 10. The dielectric insulator 20 extends into the ferule 36 of the cable connector 30 such that the insulator end 24 is positioned adjacent the end 37 of the ferrule 36. The wire conductor 26 extends outwardly from the dielectric insulator 20 and the ferrule 36 to a distance slightly beyond the front end 31 of the example cable connector 30.

Figure 5:
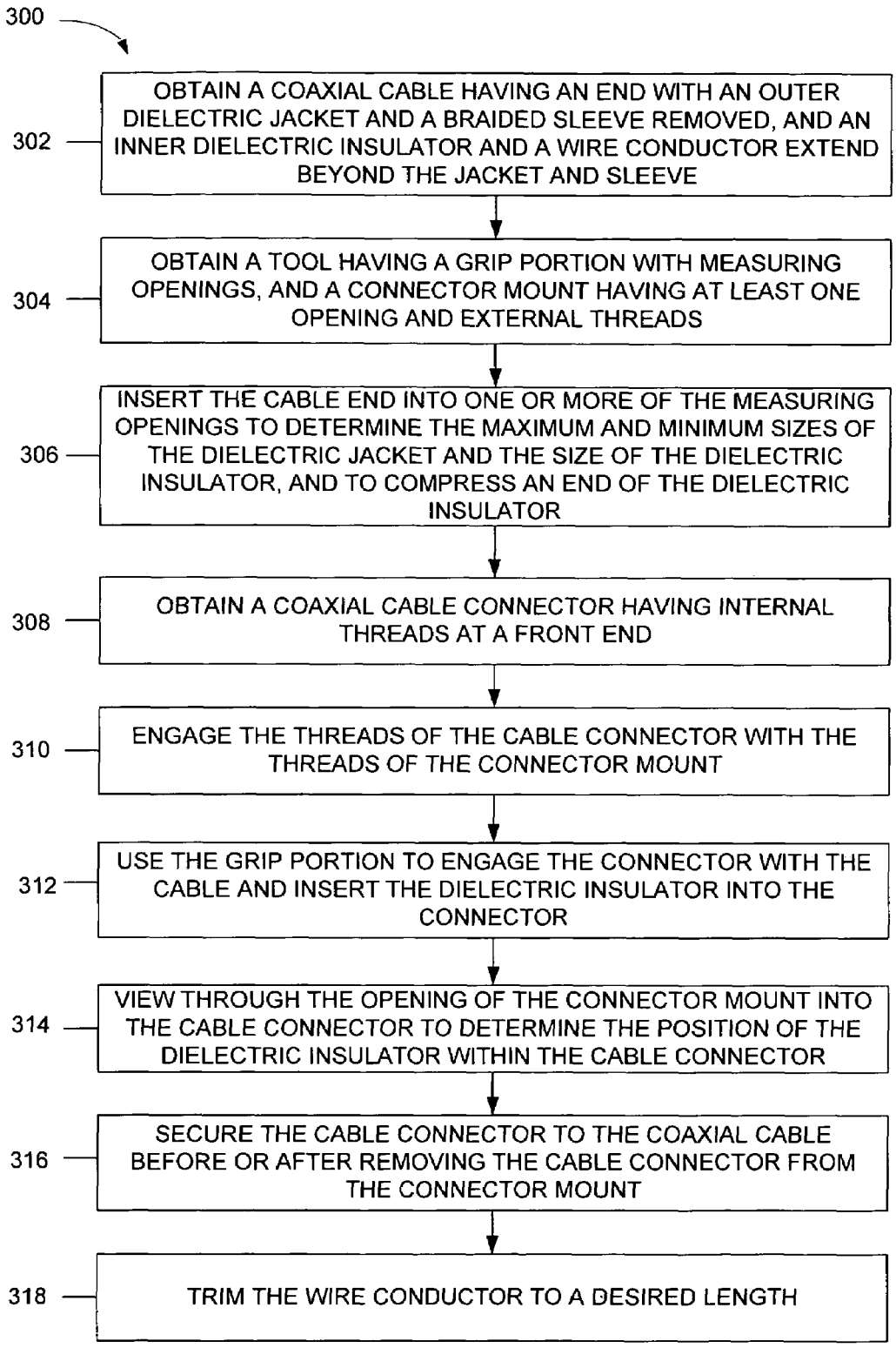
FIG. 5 is a flow chart representative of an example process to use the example tool of FIG. 3 to mount an example cable connector onto an example coaxial cable.

FIG. 5 is a flow chart which is representative of an example process or method 300 to use an example tool to mount a cable connector onto a coaxial cable. Initially, at block 302, a coaxial cable (e.g., the example coaxial cable 10 in FIG. 1) is obtained. An outer dielectric jacket and braided strands of a sleeve are removed (e.g., the outer dielectric jacket 14 and the braided strands of the sleeve 18 in FIG. 1) from an end (e.g., the distal end 12 of the example coaxial cable 10) such that a dielectric insulator and a wire conductor (e.g., the inner dielectric insulator 20 and the wire conductor 26 in FIG. 1) extend beyond the jacket and the braided strands of the sleeve. At block 304, a tool having a grip portion (e.g., the example tool 40 having a grip portion 42) with measuring openings (e.g., the measuring openings 44, 46, 48, 50, 52 and/or 54) and a connector mount having at least one opening and external threads (e.g., the connector mount 60 having the longitudinal opening 62 and the external threads 66), is obtained. The end of the coaxial cable (e.g., the distal end 12 of the example coaxial cable 10) is inserted into one or more of the measuring openings (e.g., the measuring openings 44, 46, 48, 50, 52 and/or 54) to determine if the cable conforms to the specification for the type of cable needed for the application at hand e.g., to determine the maximum and minimum sizes of the outer dielectric jacket (e.g., the outer dielectric jacket 14), and the size of the dielectric insulator (e.g., the inner dielectric insulator 20) are of the expected dimensions. Inserting the dielectric insulator into a corresponding measuring opening compresses an end of the dielectric insulator (e.g., the end 24 of the dielectric insulator 20) to facilitate insertion into a connector (e.g., the example coaxial cable connector 30 in FIG. 2) (block 306).

At block 308, a coaxial cable connector having internal threads at a front end (e.g., the example coaxial cable connector 30 in FIG. 2 with internal threads 32 at the front end 31), is obtained. The internal threads of the cable connector (e.g., the internal threads 32 of the example cable connector 30) are then threadingly engaged with the external threads of the connector mount (e.g., the external threads 66 of the connector mount 60) (block 310).

The grip portion (e.g., the grip portion 42) is used to engage the cable connector (e.g., the example cable connector 30) with the coaxial cable (e.g., the distal end 12 of the example coaxial cable 10) and to insert the dielectric insulator into the connector (e.g., see the dielectric insulator 20 in the cable connector 30 in FIG. 4), (block 312). Then, at block 314, the dielectric insulator inside the cable connector (e.g., the cable connector 30) is viewed through the opening in the connector mount (e.g., the dielectric insulator 20 is viewed through the longitudinal opening 62 in the connector mount 60) to determine the dielectric insulator's position within the cable connector (e.g., the position of the dielectric insulator 20 within the ferrule 36 inside the example cable connector 30 in FIG. 4).

If the desired position of the cable within the connector has been achieved, block 316, the cable connector is secured to the coaxial cable before or after removing the cable connector from the connector mount (e.g., the example cable connector 30 is secured to the example coaxial cable 10 in FIG. 4). The wire conductor is then trimmed to a desired length (e.g., to a quarter inch or less; see the wire conductor 26 in FIG. 4) (block 318).

Although the above example process or method 300 is described with reference to the flow chart illustrated in FIG. 5, persons of ordinary skill will readily appreciate that many other methods of utilizing the example tool 40 may alternatively be used. For example, the order of execution of the blocks may be split, changed, and/or some of the blocks described may be changed, eliminated, or combined.

The example method 300 and the example tool 40 disclosed in FIGS. 3 and 5 provide advantages over prior methods and tools. For example, a hand tool having a cylindrical extension without any threads but with coaxial cable sizing holes in the handle is known. The example tool 40 advantageously provides the threads 66 to enable the example cable connector 30 to threadingly engage the example tool 40. The example cable connector 30 is securely attached to the example tool 40 by the threaded engagement and, in particular, is securely attached by the engagement of the threads 32 of the cable connector 30 with the knurled thread 68 of the threads 66, so that the cable connector 30 will remain attached to the example tool 40 during the mounting of the cable connector 30 to the coaxial cable 10. Although the cable connector 30 is firmly connected to the example tool 40, the cable connector 30 may still be rotated and removed manually from the example tool 40. Additionally, the use of only a few threads 66 on the connector mount 60 of the example tool 40 enables the cable installer to quickly attach or detach the cable connector 30.

The coaxial cable 10 to be used for a cable installation may be checked to determine if it is the correct size coaxial cable 10 for the particular installation. The distal end 12 of the coaxial cable 10 may be inserted into the measuring openings 44, 46, 48, 50, 52 and/or 54 to determine if the coaxial cable 10 is a desired size of coaxial cable (e.g., for example RG6 or RG9). Additionally, the beveled surface 49 of measuring opening 48 and the beveled surface 55 of measuring opening 54 slightly compress the end 24 of the inner dielectric insulator 20 of the coaxial cable 10 when the cable is inserted into the respective opening, to taper or otherwise shape the end 24-of the dielectric insulator 20 for easy insertion into the ferrule 36 of the cable connector 30.

The longitudinal opening 62 in the connector mount 60 provides a significant advantage for cable installers. The cable installer may view the interior of the cable connector 30 while the cable connector 30 is attached to the example tool 40 via the opening 62. This enables the cable installer to determine the position of the inner dielectric insulator 20 relative to the end 37 of the ferrule 36, without having to remove the cable connector 30 from the example tool 40 to make that determination. As a result, the cable installer can save time and reduce the handling of the cable connector 30 by determining that the inner dielectric insulator 20 is properly positioned in the cable connector 30 while the cable connector 30 is attached to the example tool 40. Of course, the cable installer may also crimp or compress the rear end 34 of the cable connector 30 to the coaxial cable 10 before or after the coaxial cable 30 is removed from the example tool 40.

The example tool 40 may be manufactured by various manufacturing processes or techniques, including insert molding a plastic tool. Known insert molding processes or techniques may be utilized to produce a molded unitary plastic example tool 40 having the structure and the functional capabilities disclosed herein, including, for example, the grip portion 42, the connector mount 60, the threads 66, and all of the openings. Alternatively, portions of the example tool 40 may be made of metal, such as the connector mount 60, and the grip portion 42 molded at or to the connector mount 60.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A tool to mount a cable connector to a coaxial cable, the tool comprising:

a grip; and a connector mount extending from the grip and including at least one opening to enable determination of a position of a portion of the coaxial cable inside the cable connector, wherein the opening further comprises a first opening at the connector mount and a second opening in the grip such that the first and second openings are located to enable viewing of the inside of the cable connector through the first and second openings to determine the position of the portion of the coaxial cable.

2. A tool as claimed in claim 1, wherein the connector mount engages and retains thereon the cable connector so that the coaxial cable may be inserted into the cable connector.

3. A tool as claimed in claim 1, wherein the connector mount includes threads to threadingly engage threads of a cable connector.

4. A tool to mount a cable connector to a coaxial cable, the tool comprising:

a grip; and a connector mount extending from the grip and including at least one opening to enable determination of a position of a portion of the coaxial cable inside the cable connector, wherein the connector mount includes threads to threadingly engage threads of a cable connector.

5. A tool as claimed in claim 4, wherein the threads of the connector mount comprise threads to enable at least one of attachment or removal of the cable connector.

6. A tool as claimed in claim 4, wherein the threads of the connector mount include a thread having a knurled surface.

7. A tool as claimed in claim 4, wherein the connector mount has a length that enables an end of a cable connector located on the connector mount to engage the grip.

8. A tool to mount a cable connector to a coaxial cable, the tool comprising:

a grip; and a connector mount extending from the grip and including at least one opening to enable determination of a position of a portion of the coaxial cable inside the cable connector, wherein the grip includes at least one opening to receive therein a coaxial cable to determine a size of the coaxial cable.

9. A tool to mount a cable connector to a coaxial cable, the tool comprising:

a grip; and a connector mount extending from the grip and including at least one opening to enable determination of a position of a portion of the coaxial cable inside the cable connector, wherein the grip has at least three measuring openings to measure the size of and to facilitate identification of a coaxial cable, the three measuring openings including a first opening corresponding to a maximum size of an outer jacket of a predetermined cable type, a second measuring opening corresponding to a minimum size of the outer jacket of the cable type, and a third measuring opening corresponding to a size of an inner dielectric insulator of the cable type.

10. A tool as claimed in claim 9, wherein the third measuring opening includes a beveled portion to shape an end of the inner dielectric insulator inserted into the third measuring opening.

11. A tool as claimed in claim 1, wherein the grip is shaped to permit holding of the tool when mounting the cable connector to the coaxial cable.

12. A tool as claimed in claim 1, wherein the grip includes a through opening to facilitate attachment to at least one of a key ring, a belt, a strap, or a loop.

* * * * *

UNITED STATES PATENT AND TRADEMARK OFFICE

CERTIFICATE OF CORRECTION

PATENT NO. : 7,568,282 B2
APPLICATION NO. : 11/446930
DATED : August 4, 2009
INVENTOR(S) : Wollmershauser et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 147 days.

Signed and Sealed this

Seventh Day of September, 2010

David J. Kappos

David J. Kappos
*Director of the United States Patent and Trademark Office*